US012053676B2

(12) United States Patent
Hosooka et al.

(10) Patent No.: US 12,053,676 B2
(45) Date of Patent: Aug. 6, 2024

(54) GOLF CLUB HEAD

(71) Applicant: Mizuno Corporation, Osaka (JP)

(72) Inventors: Daisuke Hosooka, Osaka (JP); Kei Tsuji, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 18/003,811

(22) PCT Filed: Jul. 6, 2021

(86) PCT No.: PCT/JP2021/025490
§ 371 (c)(1),
(2) Date: Dec. 29, 2022

(87) PCT Pub. No.: WO2022/009890
PCT Pub. Date: Jan. 13, 2022

(65) Prior Publication Data

US 2023/0226417 A1 Jul. 20, 2023

(30) Foreign Application Priority Data

Jul. 7, 2020 (JP) ..... 2020-116820

(51) Int. Cl.
*A63B 53/04* (2015.01)

(52) U.S. Cl.
CPC ..... *A63B 53/0408* (2020.08); *A63B 53/0466* (2013.01)

(58) Field of Classification Search
CPC ..... A63B 53/0458; A63B 53/0462
See application file for complete search history.

(56) References Cited

U.S. PATENT DOCUMENTS 3,814,437 A * 6/1974 Winquist ..... A63B 60/00 473/324
6,997,820 B2 * 2/2006 Willett ..... A63B 60/00 473/349
9,199,138 B2 12/2015 Willett et al.
(Continued)

FOREIGN PATENT DOCUMENTS

JP 9-239075 A 9/1997
JP 2004-313354 A 11/2004
(Continued)

OTHER PUBLICATIONS

International Search Report from Application No. PCT/JP2021/025490 dated Sep. 14, 2021.

*Primary Examiner* — William M Pierce
(74) *Attorney, Agent, or Firm* — Troutman Pepper Hamilton Sanders LLP; James E. Schutz; Korbin Blunck

(57) ABSTRACT

A golf club head includes a face section, a crown section, a sole section, a heel section, and a toe section. A hollow section separated from the outside is formed inside the golf club head. The face section includes, on a back surface, a first thick section, a second thick section and a thin section thinner than the first thick section and the second thick section and disposed so as to surround the entire periphery of the first thick section and the entire periphery of the second thick section. The first thick section has a first portion disposed at the center in both the toe, and a second portion protruding from a part at the center of the first portion in the longitudinal direction toward the crown section.

19 Claims, 8 Drawing Sheets

(56) References Cited

U.S. PATENT DOCUMENTS

| | | | | |
|---|---|---|---|---|
| 11,033,785 | B1 * | 6/2021 | Carr | A63B 53/0466 |
| 2005/0090331 | A1 * | 4/2005 | Oyama | A63B 53/0466 473/345 |
| 2006/0079345 | A1 * | 4/2006 | Gibbs | A63B 53/0466 473/345 |
| 2007/0298905 | A1 | 12/2007 | Knuth | |
| 2008/0004130 | A1 * | 1/2008 | Lin | A63B 53/0466 473/342 |
| 2008/0125246 | A1 | 5/2008 | Matsunaga | |
| 2010/0105501 | A1 * | 4/2010 | Wada | A63B 53/0466 473/349 |
| 2010/0130303 | A1 * | 5/2010 | Stites | A63B 53/0466 473/349 |
| 2012/0021849 | A1 * | 1/2012 | Gibbs | A63B 53/0466 473/342 |
| 2012/0108359 | A1 | 5/2012 | Abe | |
| 2013/0029782 | A1 * | 1/2013 | Goto | A63B 53/0466 473/345 |
| 2017/0259134 | A1 * | 9/2017 | Ines | B21K 17/00 |
| 2019/0046845 | A1 | 2/2019 | Greensmith et al. | |
| 2020/0114227 | A1 | 4/2020 | Schweigert et al. | |
| 2022/0184469 | A1 * | 6/2022 | Greaney | A63B 53/0454 |
| 2023/0072146 | A1 * | 3/2023 | Carr | A63B 53/0458 |
| 2023/0347213 | A1 * | 11/2023 | Carr | A63B 53/0462 |
| 2024/0075354 | A1 * | 3/2024 | Gibbs | A63B 53/0466 |

FOREIGN PATENT DOCUMENTS

| | | | |
|---|---|---|---|
| JP | 2011-72368 | A | 4/2011 |
| JP | 2011-135980 | A | 7/2011 |
| JP | 2011-152275 | A | 8/2011 |
| JP | 2012-71111 | A | 4/2012 |
| JP | 2012-95855 | A | 5/2012 |
| JP | 2013-202143 | A | 10/2013 |
| JP | 2014-113367 | A | 6/2014 |

* cited by examiner

GOLF CLUB HEAD

CLAIM OF PRIORITY

This application is a § 371 national stage of International Application PCT/JP2021/025490, with an international filing date of 6 Jul. 2021, which claims benefit to Japanese Patent Application No. 2020-116820 filed 7 Jul. 2020, the entireties of which are incorporated herein by reference as if set forth in their entirety.

TECHNICAL FIELD

The present invention relates to a golf club head.

BACKGROUND ART

Japanese Patent Laying-Open No. 2004-313354 (PTL 1) discloses a golf club head having a hollow section formed therein and including a face section that includes a center thick section where a sweet spot is present, a lower thick section formed at an end adjacent to a sole section, an upper thick section formed at an end adjacent to a crown section, and a thin section disposed between the center thick section and the lower thick section and between the center thick section and the upper thick section.

CITATION LIST

Patent Literature

PTL 1: Japanese Patent Laying-Open No. 2004-313354

SUMMARY OF INVENTION

Technical Problem

In the golf club head disclosed in PTL 1, the end adjacent to the sole section and the end adjacent to the crown section are formed as thick sections, so that a high-resilience area in the face section is limited to an area inside the end adjacent to the sole section and the end adjacent to the crown section.

It is therefore a main object of the present invention to provide a golf club head that is larger in high-resilience area in a face section and higher in durability than a golf club head in the related art.

Solution to Problem

A golf club head according to the present invention includes a face section, a crown section, a sole section, a heel section, and a toe section. A hollow section separated from the outside is formed inside the golf club head. The face section includes, on a back surface, a first thick section disposed substantially at the center in a toe-heel direction going from the toe section to the heel section, a second thick section disposed adjacent to the sole section relative to the first thick section, and a thin section thinner than the first thick section and the second thick section and disposed so as to surround the entire periphery of the first thick section and the entire periphery of the second thick section. The first thick section includes a first portion disposed substantially at a center in both the toe-heel direction and a crown-sole direction going from the crown section to the sole section and having a longitudinal direction coincident with the toe-heel direction, and a second portion protruding from a part at a center of the first portion in the longitudinal direction toward the crown section.

Advantageous Effects of Invention

According to the present invention, it is possible to provide a golf club head that is larger in high-resilience area in a face section and higher in durability than a golf club head in the related art.

DESCRIPTION OF EMBODIMENTS

Figure 1:
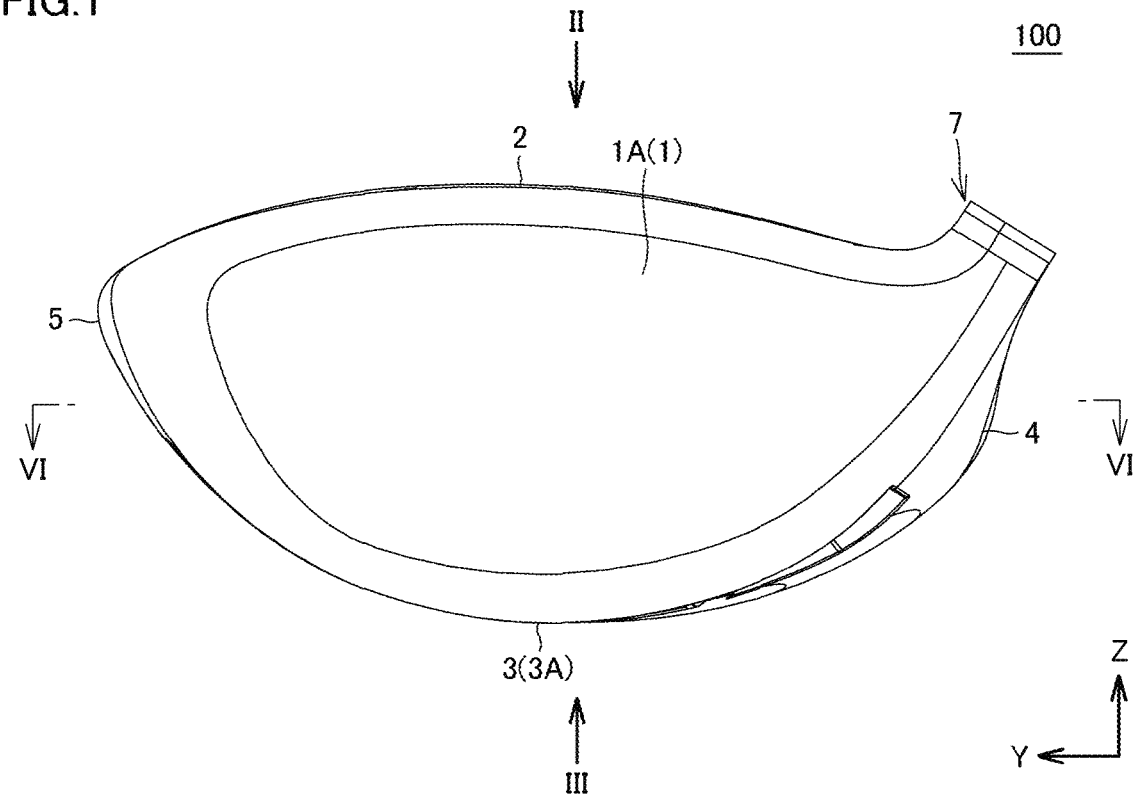
FIG. 1 is a front view of a golf club head according to an embodiment.

With reference to the drawings, an embodiment according to the present invention will be described below. Note that, in the following drawings, the same or corresponding parts are denoted by the same reference numerals, and no redundant description will be given of such parts.

Structure of Golf Club Head

With reference to FIGS. 1 to 7, a structure of a golf club head 100 according to the present embodiment will be described. As an example of the present embodiment, golf club head 100 illustrated in FIGS. 1 to 7 is a wood-type golf club head used for a driver golf club. Golf club head 100 may be a golf club head used for a fairway wood golf club or utility club.

Figure 2:
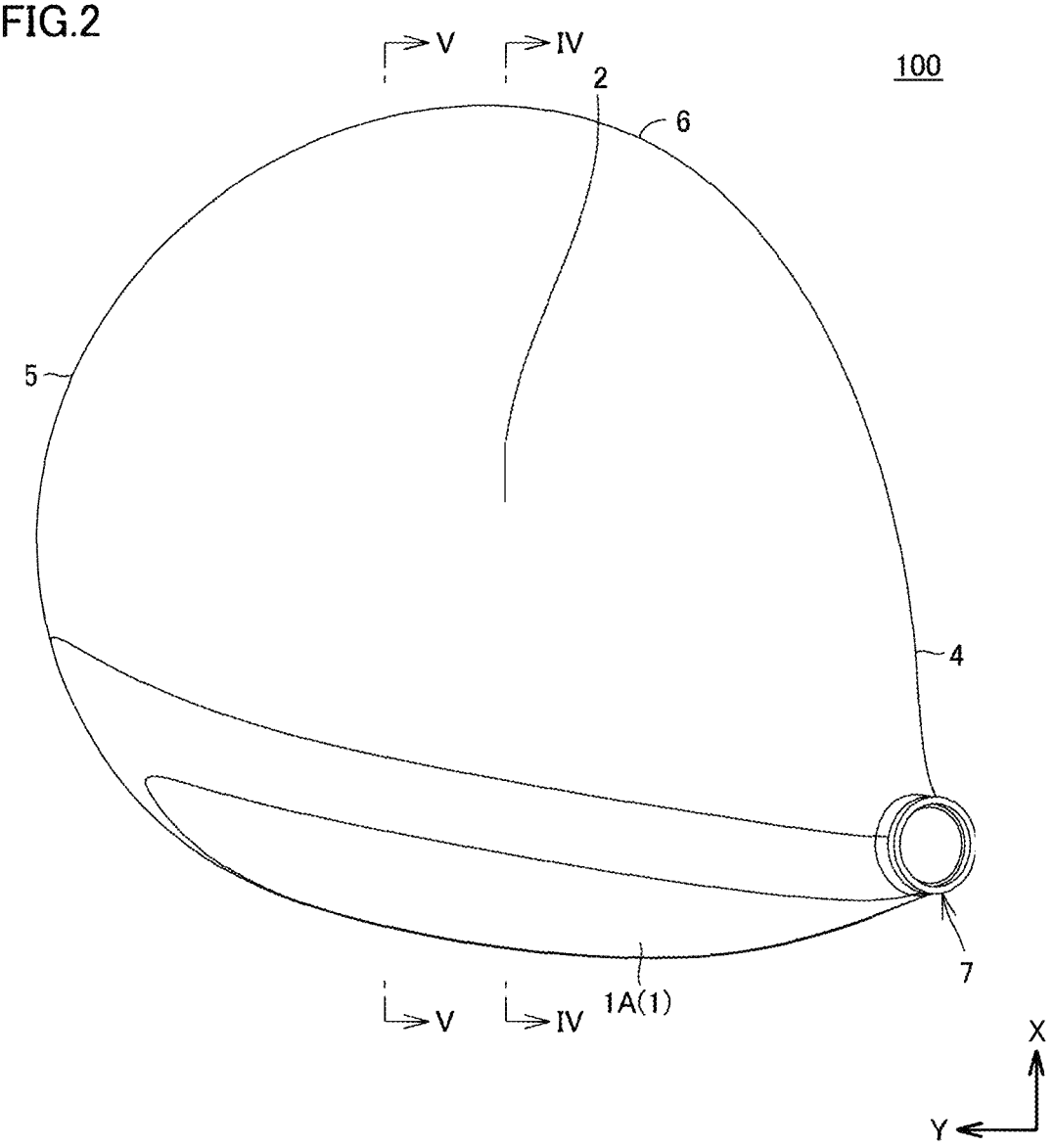
FIG. 2 is a plan view as viewed from an arrow II in FIG. 1.
Figure 3:
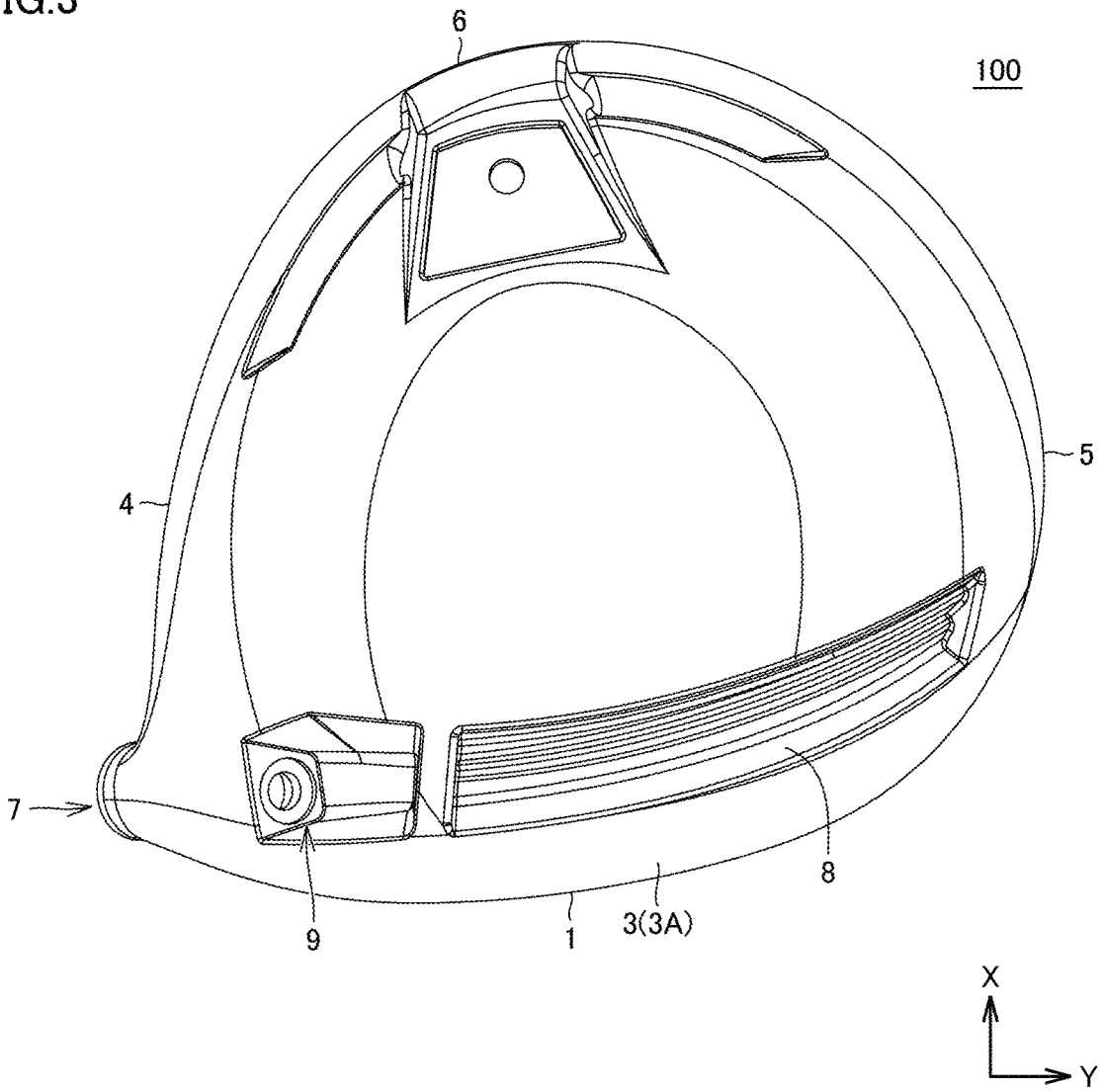
FIG. 3 is a bottom view as viewed from an arrow III in FIG. 1.

Note that FIG. 1 is a front view of golf club head 100 that is set on a horizontal plane so as to form a predetermined loft angle and lie angle with the horizontal plane (hereinafter, referred to as a set state). A first direction Z illustrated in FIGS. 1 and 7 is an upward direction. A second direction Y illustrated in FIGS. 1 to 7 is a direction intersecting first direction Z and in parallel with the horizontal plane. A third direction X illustrated in FIGS. 2 and 3 is a direction intersecting first direction Z and second direction Y and in parallel with the horizontal plane.

As illustrated in FIGS. 1 to 3, golf club head 100 includes a face section 1, a crown section 2, a sole section 3, a heel section 4, a toe section 5, a back section 6, and a hosel section 7.

As illustrated in FIGS. 1 to 3, face section 1 has a striking surface 1A and a back surface 1B positioned on the opposite side from striking surface 1A and facing the hollow section. As illustrated in FIGS. 4 to 7, face section 1 has an outer peripheral surface 1C connected to crown section 2, sole section 3, heel section 4, and toe section 5. Outer peripheral surface 1C connects striking surface 1A and back surface 1B and extends in a direction intersecting striking surface 1A and back surface 1B. Of outer peripheral surface 1C, an upper end surface section 1C2 positioned on an upper side in the set state is connected to crown section 2. Of outer peripheral surface 1C, a lower end surface section 1C3 positioned on a lower side in the set state is connected to sole section 3. For example, a plurality of score lines (not illustrated) are formed on striking surface 1A. Details of face section 1 will be described later.

Crown section 2 is a section disposed above face section 1 in the set state. Crown section 2 serves as a top of golf club head 100. Crown section 2 is contiguous to face section 1. Crown section 2 has a lower end surface connected to upper end surface section 1C2 of face section 1.

Sole section 3 is a section positioned below face section 1 in the set state. Sole section 3 serves as a bottom of golf club head 100. Sole section 3 has a sole surface 3A that comes into contact with the ground when hitting a ball. Sole surface 3A is a curved surface. Sole section 3 is contiguous to face section 1. Sole section 3 has an upper end surface connected to lower end surface section 1C3 of face section 1.

Heel section 4 is a section extending from a lower end of hosel section 7 to sole section 3. Heel section 4 is contiguous to face section 1. Toe section 5 is a section connecting crown section 2 and sole section 3 on a side remote from hosel section 7. Back section 6 is a section smoothly connecting crown section 2 and sole section 3 on a side remotest from striking surface 1A in a direction perpendicular to striking surface 1A. A shaft 110 is connected to hosel section 7 of a golf club 200 (to be described later).

Hereinafter, a direction going from toe section 5 to heel section 4 along face section 1 is referred to as a toe-heel direction. A direction going from crown section 2 to sole section 3 along face section 1 is referred to as a crown-sole direction. A direction going from face section 1 to the back section is referred to as a face-back direction.

Figure 4:
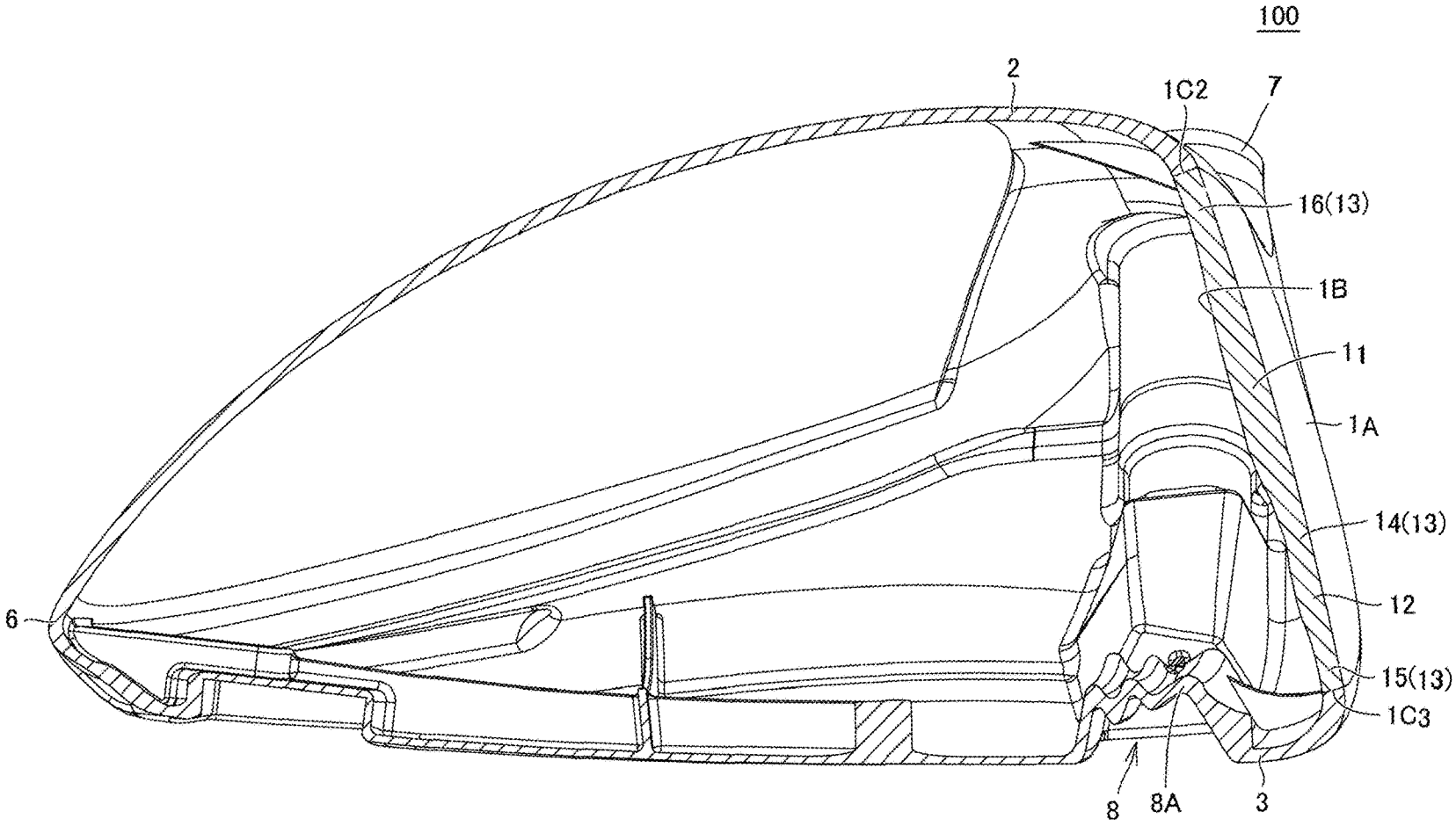
FIG. 4 is a cross-sectional view as viewed from an arrow IV-IV in FIG. 2.
Figure 5:
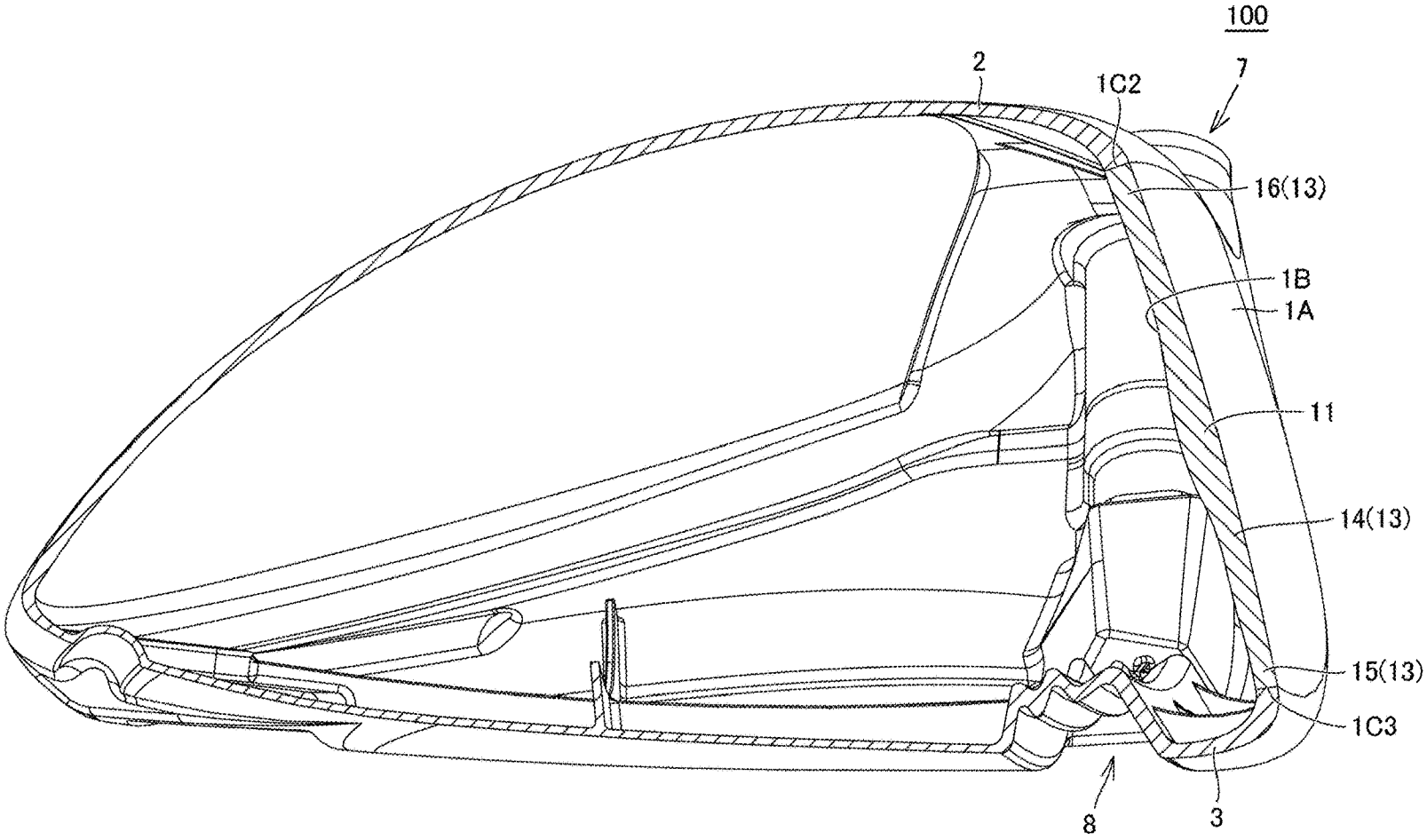
FIG. 5 is a cross-sectional view as viewed from an arrow V-V in FIG. 2.
Figure 6:
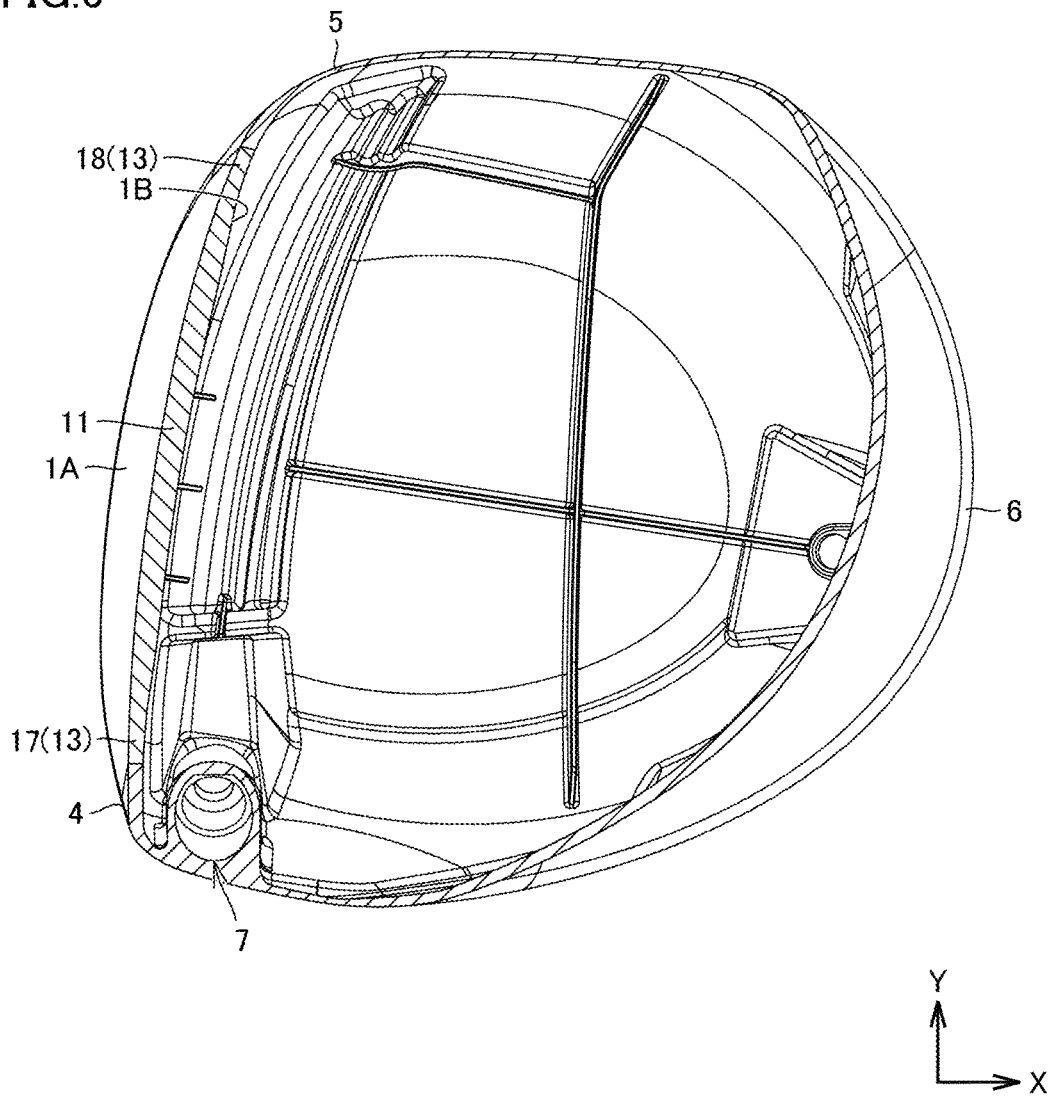
FIG. 6 is a cross-sectional view as viewed from an arrow VI-VI in FIG. 1.
Figure 7:
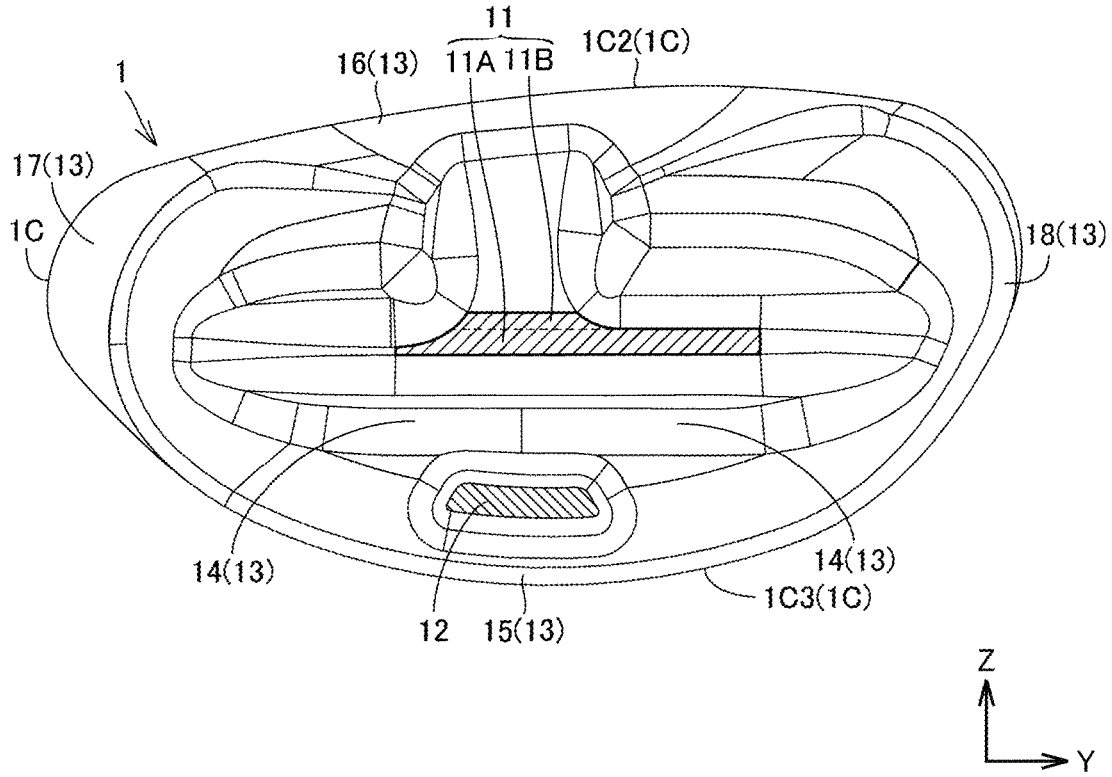
FIG. 7 is a rear view of a face section alone as viewed from a back surface of the face section before being attached to the golf club head illustrated in FIG. 1.

As illustrated in FIGS. 4 to 6, golf club head 100 has a hollow section 101 formed therein. Hollow section 101 is separated from the outside of golf club head 100 by face section 1, crown section 2, sole section 3, heel section 4, toe section 5, back section 6, and hosel section 7. Hollow section 101 is positioned between face section 1 and back section 6 in the face-back direction, between crown section 2 and sole section 3 in the crown-sole direction, and between heel section 4 and toe section 5 in the toe-heel direction.

A material of which face section 1, toe section 5, heel section 4, crown section 2, sole section 3, back section 6, and hosel section 7 are each made includes at least one selected from the group consisting of pure titanium (Ti), a titanium alloy, iron (Fe), stainless steel, and special steel, for example.

The titanium alloy of which face section 1, toe section 5, heel section 4, crown section 2, sole section 3, back section 6, and hosel section 7 are each made may be any titanium alloy, and examples of such a titanium alloy include an α titanium alloy (for example, 5AL-2.5V), an α-β titanium alloy (for example, Ti-6Al-4V, Ti811 (Ti-8Al-1Mo-1V)), and a β titanium alloy (for example, SAT2041, Ti-15V-3Cr-3Sn-3AL). The stainless steel of which face section 1, crown section 2, sole section 3, heel section 4, toe section 5, back section 6, and hosel section 7 are each made may be any stainless steel, and examples of such stainless steel include austenitic stainless steel (for example, SUS304), martensitic stainless steel (for example, SUS431), and precipitation hardening stainless steel (for example, SUS630). Examples of the special steel of which face section 1, crown section 2, sole section 3, heel section 4, toe section 5, back section 6, and hosel section 7 are each made include high-tensile steel, ultra-high-tensile steel, ausforming steel, maraging steel, and spring steel.

Face section 1, crown section 2, sole section 3, heel section 4, toe section 5, back section 6, and hosel section 7 may be made of the same material or different materials. As an example, a material of which crown section 2, sole section 3, heel section 4, toe section 5, back section 6, and hosel section 7 is each made is an α-β titanium alloy, and a material of which face section 1 is made is a β titanium alloy.

Structure of Face Section

FIG. 4 is a cross-sectional view as viewed from an arrow IV-IV in FIG. 2. FIG. 4 is a cross-sectional view taken along a plane passing through the center of face section 1 in the toe-heel direction and extending in the crown-sole direction. FIG. 5 is a cross-sectional view as viewed from an arrow V-V in FIG. 2. FIG. 5 is a cross-sectional view taken along a plane passing through a point closer to toe section 5 than the center of face section 1 in the toe-heel direction and extending in the crown-sole direction. FIG. 6 is a cross-sectional view as viewed from an arrow VI-VI in FIG. 1. FIG. 6 is a cross-sectional view taken along a plane passing through the center of face section 1 in the crown-sole direction and extending in the toe-heel direction. FIG. 7 is a rear view of face section 1 alone as viewed from back surface 1B. In FIG. 7, solid lines illustrated inside the contour indicating outer peripheral surface 1C indicate ridge lines of an uneven structure formed on back surface 1B.

As illustrated in FIGS. 4 to 6, face section 1 has a plurality of portions different in thickness. A thickness of face section 1 corresponds to a width of face section 1 in the direction perpendicular to striking surface 1A. A thickness distribution of face section 1 is determined based on the uneven structure on back surface 1B illustrated in FIG. 7.

As illustrated in FIG. 7, face section 1 mainly includes a first thick section 11, a second thick section 12, and a thin section 13. In FIG. 7, hatching is applied to first thick section 11 and second thick section 12 in order to make first thick section 11 and second thick section 12 clear. All areas that are not hatched in FIG. 7 serve as thin section 13.

First thick section 11 is disposed substantially at the center in the toe-heel direction. First thick section 11 has a first portion 11A and a second portion 11B. First portion 11A of first thick section 11 is disposed substantially at the center in the toe-heel direction and the crown-sole direction. Second portion 11B of first thick section 11 is disposed substantially at the center in the toe-heel direction. Note that "substantially at the center in the toe-heel direction" means, for example, an area extending by 12 mm toward both the toe section and the heel section from a first imaginary center straight line passing through the center in the toe-heel direction and extending in the crown-sole direction. "Substantially at the center in the crown-sole direction" means, for example, an area extending by 12 mm toward both the crown section and the sole section from a second imaginary center straight line passing through the center in the crown-sole direction and extending in the toe-heel direction. First thick section 11 is, for example, the thickest portion of face section 1.

Second thick section 12 is disposed closer to sole section 3 than first thick section 11. Second thick section 12 is disposed between first thick section 11 and sole section 3 in the crown-sole direction. Second thick section 12 is thinner than first thick section 11. Second thick section 12 is not in contact with sole section 3. A second thin portion 15 (to be described later) of thin section 13 is disposed between second thick section 12 and sole section 3.

Thin section 13 is thinner than first thick section 11 and second thick section 12. Thin section 13 is disposed so as to surround the entire periphery of first thick section 11 and the entire periphery of second thick section 12.

As illustrated in FIGS. 4 to 6, thin section 13 has a plurality of portions different in thickness. The thickest portion of thin section 13 is thinner than the thinnest portion of first thick section 11 and the thinnest portion of second thick section 12. Face section 1 smoothly changes in thickness at a connection portion between an outer edge of first thick section 11 and an outer edge of thin section 13. Face section 1 smoothly changes in thickness at a connection portion between an outer edge of second thick section 12 and the outer edge of thin section 13. The thickest portion of thin section 13 is, for example, the connection portion between the outer edge of first thick section 11 and the outer edge of thin section 13.

As illustrated in FIGS. 4 to 7, thin section 13 includes a first thin portion 14, a second thin portion 15, a third thin portion 16, a fourth thin portion 17, and a fifth thin portion 18, which are defined based on the ridge lines or positions on back surface 1B illustrated in FIG. 7. First thin portion 14 is disposed between first thick section 11 and second thick section 12. Second thin portion 15 is a portion of face section 1 connected to sole section 3. Second thin portion 15 is partially disposed between second thick section 12 and sole section 3. Third thin portion 16 is a portion of face section 1 connected to crown section 2. Third thin portion 16 is partially disposed between first thick section 11 and crown section 2. Fourth thin portion 17 is a portion of face section 1 connected to heel section 4. Fourth thin portion 17 is partially disposed between first thick section 11, second thick section 12, and first thin portion 14, and heel section 4. Fifth thin portion 18 is a portion of face section 1 connected to toe section 5. Fifth thin portion 18 is partially disposed between first thick section 11, second thick section 12, and first thin portion 14, and toe section 5. In other words, crown section 2, sole section 3, heel section 4, and toe section 5 are each connected to thin section 13 of face section 1.

As illustrated in FIG. 7, first portion 11A has a longitudinal direction coincident with the toe-heel direction and a lateral direction coincident with the crown-sole direction. Second portion 11B protrudes from a part at the center of first portion 11A in the longitudinal direction toward crown section 2. Second portion 11B has, for example, a longitudinal direction coincident with the toe-heel direction and a lateral direction coincident with the crown-sole direction. An end of first portion 11A adjacent to crown section 2 is connected to an end of second portion 11B adjacent to sole section 3. The maximum thickness of first portion 11A is equal to, for example, the maximum thickness of second portion 11B.

As illustrated in FIG. 7, first thick section 11 has an inverted T shape when face section 1 is viewed from back surface 1B. Herein, the inverted T shape is defined as a three-dimensional area including only first portion 11A having a longitudinal direction coincident with the toe-heel direction and a lateral direction coincident with the crown-sole direction, and second portion 11B protruding from a part at the center of first portion 11A in the longitudinal direction toward crown section 2. As described above, second portion 11B has, for example, a longitudinal direction coincident with the toe-heel direction and a lateral direction coincident with the crown-sole direction.

In the cross section illustrated in FIG. 4, face section 1 mainly includes first thick section 11, second thick section 12, and first thin portion 14, second thin portion 15, and third thin portion 16 of thin section 13. As illustrated in FIGS. 4 and 7, second thin portion 15 is, for example, thinner than first thin portion 14. A lower end surface of second thin portion 15 serves as lower end surface section 1C3 of face section 1. Third thin portion 16 is, for example, thinner than first thin portion 14. An upper end surface of third thin portion 16 serves as upper end surface section 1C2 of face section 1. At least either second thin portion 15 or third thin portion 16 is the thinnest portion of face section 1 in the cross section illustrated in FIG. 4. Second thin portion 15 is, for example, thinner than third thin portion 16 and is thus the thinnest portion of face section 1 in the cross section illustrated in FIG. 4.

In the cross section illustrated in FIG. 4, third thin portion 16, first thick section 11, first thin portion 14, second thick section 12, and second thin portion 15 are arranged side by side in the crown-sole direction from crown section 2 to sole section 3 in this order. In the cross section illustrated in FIG. 4, face section 1 gradually changes in thickness in the crown-sole direction.

In the cross section illustrated in FIG. 5, face section 1 mainly includes first thick section 11, first thin portion 14, second thin portion 15, and third thin portion 16, but does not include second thick section 12. In the cross section illustrated in FIG. 5, face section 1 gradually decreases in thickness from first thick section 11 to sole section 3. In the cross section illustrated in FIG. 5, third thin portion 16, first thick section 11, first thin portion 14, and second thin portion 15 are arranged side by side in the crown-sole direction from crown section 2 to sole section 3 in this order. In the cross section illustrated in FIG. 5, thin section 13 gradually decreases in thickness from first thin portion 14 to second thin portion 15.

In the cross section illustrated in FIG. 6, face section 1 mainly includes first thick section 11, fourth thin portion 17, and fifth thin portion 18. In the cross section illustrated in FIG. 6, fourth thin portion 17, first thick section 11, and fifth thin portion 18 are arranged side by side in the toe-heel direction from heel section 4 to toe section 5 in this order. Heel section 4 is connected to fourth thin portion 17. Toe section 5 is connected to fifth thin portion 18. In the cross section illustrated in FIG. 6, face section 1 gradually changes in thickness in the toe-heel direction.

As illustrated in FIG. 7, first thick section 11, second thick section 12, first thin portion 14, and second thin portion 15 each have, for example, a longitudinal direction coincident with the toe-heel direction and a lateral direction coincident with the crown-sole direction.

The width of each of first thick section 11, second thick section 12, first thin portion 14, and second thin portion 15 in the toe-heel direction is not limited to any specific width. The width may be determined as desired in a manner that depends on the face shape.

The width of each of first thick section 11, second thick section 12, first thin portion 14, and second thin portion 15 in the crown-sole direction is not limited to any specific width. The width may be determined as desired in a manner that depends on the face shape.

When golf club head 100 is a head of a fairway wood golf club or a head of a utility golf club, first thick section 11 has a thickness greater than or equal to 1.9 mm and less than or equal to 2.3 mm, second thick section 12 has a thickness greater than or equal to 1.8 mm and less than or equal to 2.2 mm, and second thin portion 15 and third thin portion 16 each have a thickness greater than or equal to 1.7 mm and less than or equal to 2.1 mm, for example. When golf club head 100 is a driver golf club, first thick section 11 has a thickness greater than or equal to 3.4 mm and less than or equal to 3.8 mm, second thick section 12 has a thickness greater than or equal to 2.5 mm and less than or equal to 2.9 mm, and second thin portion 15 and third thin portion 16 each have a thickness greater than or equal to 1.8 mm and less than or equal to 2.2 mm, for example.

A method for manufacturing golf club head 100 may be any manufacturing method, but, for example, members each made by forging or casting are welded together to form golf club head 100. Crown section 2, sole section 3, heel section 4, and toe section 5 are formed in a single body by solid casting, for example. The single body has a hollow section and an opening formed therein, the opening communicating with the hollow section. Face section 1 covers the opening. Outer peripheral surface 1C of face section 1 is welded to an end surface of the opening of the molded body. In this case, a parting line is formed, due to casting, on an edge of the end surface of the opening adjacent to the hollow section, so that face section 1 can be defined as a portion including striking surface 1A and surrounded by the parting line.

Actions and Effects

In golf club head 100, first thick section 11 and second thick section 12 are each entirely surrounded by thin section 13, so that thin section 13 of face section 1 is connected to sole section 3, specifically, to second thin portion 15. This can make a whole area between first thick section 11 and second thin portion 15 in face section 1 of golf club head 100 higher in resilience than the end adjacent to the sole section disclosed in PTL 1. This can make golf club head 100 larger in high-resilience area in the face section than the golf club head disclosed in PTL 1 in which the end adjacent to the sole section is formed as a thick section. Such a golf club head 100 makes face section 1 flexible even when a ball is hit at a point shifted from the sweet spot toward the sole section, that is, off-center shot, for example. This allows golf club head 100 to make a difference in distance between the sweet-spot shot and the off-center shot small as compared with the golf club head disclosed in PTL 1.

Face section 1 of golf club head 100 further includes second thick section 12 disposed closer to sole section 3 than first thick section 11. When face section 1 does not include second thick section 12, face section 1 may become insufficient in durability. Further, when face section 1 does not include second thick section 12 and has a whole area between first thick section 11 and second thin portion 15 of face section 1 formed as a thin section, face section 1 may become too high in resilience. In golf club head 100, face section 1 includes second thin portion 15 and second thick section 12, thereby providing face section 1 with high durability and high resilience.

In golf club head 100, in the cross-section illustrated in FIG. 4, third thin portion 16 of face section 1 is connected to crown section 2. This makes a whole area between third thin portion 16 connected to crown section 2 and second thin portion 15 connected to sole section 3 in face section 1 of golf club head 100 flexible. That is, this makes golf club head 100 larger in high-resilience area in the face section than the golf club head disclosed in PTL 1 in which the end adjacent to the sole section and the end adjacent to the crown section are each formed as a thick section. Such a golf club head 100 makes face section 1 flexible even when a ball is hit at a point shifted from the sweet spot toward the crown section, that is, off-center shot, for example.

Structure of Golf Club

Figure 8:
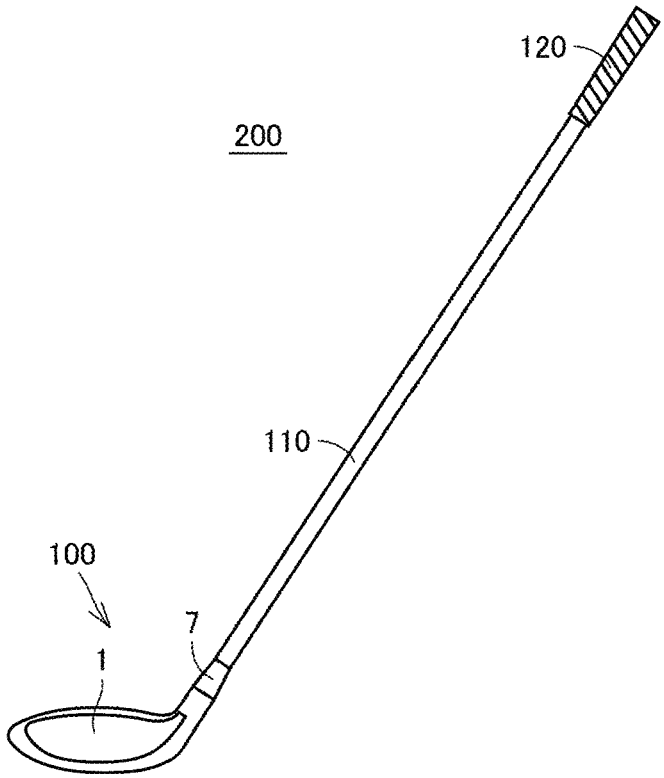
FIG. 8 is a perspective view of a golf club according to the embodiment.

As illustrated in FIG. 8, golf club 200 includes golf club head 100, shaft 110, and a grip 120. Shaft 110 has one end attached to hosel section 7 of golf club head 100. Shaft 110 has the other end attached to grip 120.

EXAMPLE

In the present example, a result of evaluation of a characteristic time (CT) value of a face section will be described. As an example, golf club head 100 described above was prepared. As a comparative example, a golf club head having a thick section formed extending from the center of the face section to the lower end of the face section and having a thin section formed only in an area adjacent to the crown section, the toe section, and the heel section relative to the thick section was prepared. In other words, as the comparative example, a golf club head having neither the second thick section nor the thin section disposed so as to surround the entire periphery of the second thick section was prepared. The CT value is measured according to a procedure defined by the United States Golf Association (USGA).

Figure 9:
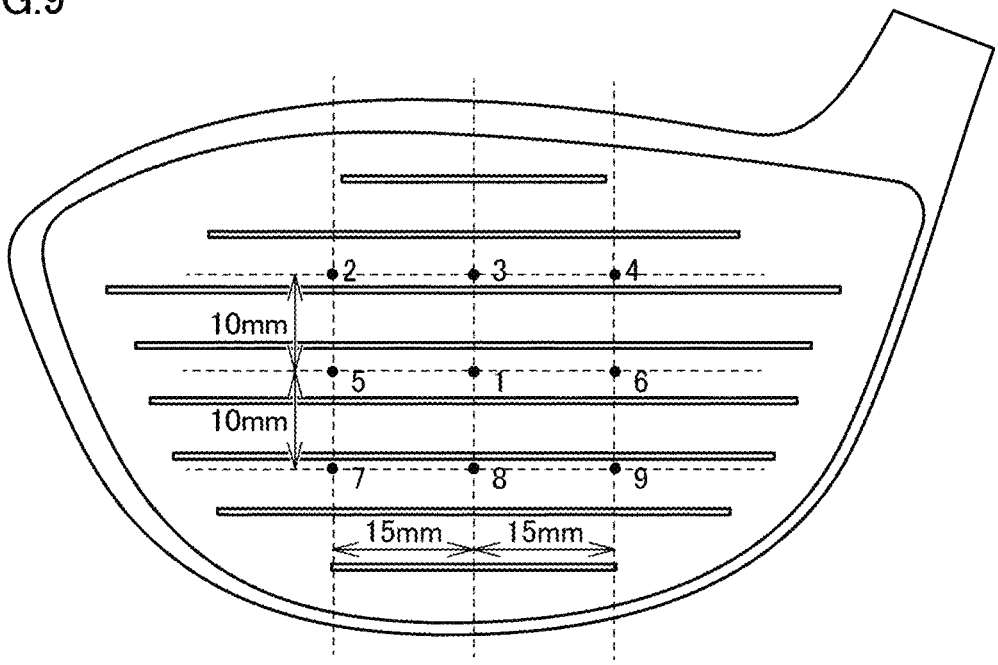
FIG. 9 is a front view of a golf club head according to an example.

FIG. 9 illustrates CT value measurement points 1 to 9 on the face section of a driver. As illustrated in FIG. 9, the sweet spot was set as measurement point 1. The measurement points 2 to 9 were each set at a corresponding intersection of six imaginary straight lines drawn in a lattice pattern centered on measurement point 1. An interval in the toe-heel direction between three imaginary straight lines of the six imaginary straight lines extending in the crown-sole direction was set to 15 mm. An interval in the crown-sole direction between three imaginary straight lines extending in the toe-heel direction was set to 10 mm. Note that, in this example, measurement points 1, 5, 6 were set on the first thick section. In this example, measurement points 7, 8, 9 were set on second thin portion 15. In this example, measurement points 2, 3, 4 were set on third thin portion 16. Further, in the comparative example, measurement points 1, 3, 5, 6, 8 were set on the thick section, and measurement points 2, 4, 7, 9 were set on the thin section.

Table 1 shows ratios obtained by normalizing the CT values measured at measurement points 1 to 9 of the example and the comparative example with the CT value measured at measurement point 1 of the example set to 1.

TABLE 1

| Measurement point | 1 | 2 | 3 | 4 | 5 | 6 | 7 | 8 | 9 |
|---|---|---|---|---|---|---|---|---|---|
| Example | 1.00 | 1.01 | 0.94 | 0.95 | 0.98 | 0.97 | 0.96 | 0.98 | 0.92 |
| Comparative Example | 0.98 | 0.96 | 0.92 | 0.96 | 0.95 | 0.97 | 0.93 | 0.91 | 0.90 |

Table 1 shows that the example is higher than the comparative example in the ratios of measurement points 7, 8, 9 positioned closer to the sole section than measurement point 1. In particular, the ratio of the CT value of measurement point 8 of the example was greatly improved as compared with the ratio of the CT value of measurement point 8 of the comparative example, and was almost equal to the ratios of the CT values of measurement point 5 and measurement point 6 of the example arranged side by side with measurement point 1 in the toe-heel direction.

It should be understood that the embodiment disclosed herein is illustrative in all respects and not restrictive. The scope of the present invention is defined by the claims rather than the above description and is intended to include the claims, equivalents of the claims, and all modifications within the scope.

REFERENCE SIGNS LIST

1: face section, 1A: striking surface, 1B: back surface, 1C: outer peripheral surface, 1C2: upper end surface section, 1C3: lower end surface section, 2: crown section, 3: sole section, 3A: sole surface, 4: heel section, 5: toe section, 6: back section, 7: hosel section, 8: first depression, 8A: bottom, 9: second depression, 11: first thick section, 11A: first portion, 11B: second portion, 12: second thick section, 13: thin section, 14: first thin portion, 15: second thin portion, 16: third thin portion, 17: fourth thin portion, 18: fifth thin portion, 19: third thick section, 20: sixth thin portion, 100: golf club head, 101: hollow section, 110: shaft, 120: grip, 200: golf club

The invention claimed is:

1. A golf club head comprising:

a face section;

a crown section;

a sole section;

a heel section; and a toe section, wherein a hollow section separated from an outside is formed, the face section includes, on a back surface, a first thick section disposed substantially at a center in a toe-heel direction going from the toe section to the heel section, a second thick section disposed closer to the sole section than the first thick section, and a thin section thinner than the first thick section and the second thick section and disposed so as to surround an entire periphery of the first thick section and an entire periphery of the second thick section, and the first thick section includes a first portion disposed substantially at a center in both the toe-heel direction and a crown-sole direction going from the crown section to the sole section and having a longitudinal direction coincident with the toe-heel direction, and a second portion protruding from a part at a center of the first portion in the longitudinal direction toward the crown section.

2. The golf club head according to claim 1, wherein the first thick section has an inverted T shape when the face section is viewed from the back surface.

3. The golf club head according to claim 1, wherein the thin section has a plurality of portions different in thickness, and a thickest portion of the thin section is thinner than a thinnest portion of the first thick section and a thinnest portion of the second thick section.

4. The golf club head according to claim 3, wherein the thin section includes a third portion disposed between the first thick section and the second thick section in the crown-sole direction, and a fourth portion disposed between the second thick section and the sole section in the crown-sole direction, and the fourth portion is thinner than the third portion.

5. The golf club head according to claim 1, wherein the crown section, the sole section, the heel section, and the toe section are each connected to the thin section of the face section.

6. The golf club head according to claim 1, wherein in the toe-heel direction, a width of the second thick section is narrower than a width of the first thick section.

7. The golf club head according to claim 2, wherein the thin section has a plurality of portions different in thickness, and a thickest portion of the thin section is thinner than a thinnest portion of the first thick section and a thinnest portion of the second thick section.

8. The golf club head according to claim 7, wherein the thin section includes a third portion disposed between the first thick section and the second thick section in the crown-sole direction, and a fourth portion disposed between the second thick section and the sole section in the crown-sole direction, and the fourth portion is thinner than the third portion.

9. The golf club head according to a claim 2, wherein the crown section, the sole section, the heel section, and the toe section are each connected to the thin section of the face section.

10. The golf club head according to a claim 3, wherein the crown section, the sole section, the heel section, and the toe section are each connected to the thin section of the face section.

11. The golf club head according to a claim 4, wherein the crown section, the sole section, the heel section, and the toe section are each connected to the thin section of the face section.

12. The golf club head according to a claim 7, wherein the crown section, the sole section, the heel section, and the toe section are each connected to the thin section of the face section.

13. The golf club head according to a claim 8, wherein the crown section, the sole section, the heel section, and the toe section are each connected to the thin section of the face section.

14. The golf club head according to claim 2, wherein in the toe-heel direction, a width of the second thick section is narrower than a width of the first thick section.

15. The golf club head according to claim 3, wherein in the toe-heel direction, a width of the second thick section is narrower than a width of the first thick section.

16. The golf club head according to claim 4, wherein in the toe-heel direction, a width of the second thick section is narrower than a width of the first thick section.

17. The golf club head according to claim 5, wherein in the toe-heel direction, a width of the second thick section is narrower than a width of the first thick section.

18. The golf club head according to claim 7, wherein in the toe-heel direction, a width of the second thick section is narrower than a width of the first thick section.

19. The golf club head according to claim 8, wherein in the toe-heel direction, a width of the second thick section is narrower than a width of the first thick section.

* * * * *